US005308008A

United States Patent [19]

Rüegg

[11] Patent Number: 5,308,008

[45] Date of Patent: May 3, 1994

[54] METHOD AND APPARATUS FOR PRODUCING ROLLS

[76] Inventor: Anton Rüegg, St. Gallerstrasse 34, 8716 Schmerikon, Switzerland

[21] Appl. No.: 897,939

[22] Filed: Jun. 15, 1992

[30] Foreign Application Priority Data

Mar. 18, 1992 [CH] Switzerland ..... 00870/92

[51] Int. Cl.[5] ..... B65H 18/16

[52] U.S. Cl. ..... 242/65

[58] Field of Search ..... 242/65, 66, 56 R, 67.1 R, 242/67.2, 75.1, 76, 75.2, 56.9

[56] References Cited

U.S. PATENT DOCUMENTS

| | | | |
|---|---|---|---|
| 3,279,718 | 10/1966 | Arterton et al. | 242/65 X |
| 3,670,980 | 6/1972 | Mukai et al. | 242/75.2 X |
| 3,834,642 | 9/1974 | Kampf | 242/67.1 R X |
| 4,049,212 | 9/1977 | Yamaguchi et al. | 242/65 X |
| 4,171,107 | 10/1979 | Kayser et al. | 242/75.2 X |
| 4,191,341 | 3/1980 | Looser . | |
| 4,343,440 | 8/1982 | Engl | 242/67.1 R |
| 4,491,283 | 1/1985 | Pav et al. | 242/67.1 R |
| 4,524,919 | 6/1985 | Wehrmann | 242/67.1 R |
| 4,552,317 | 11/1985 | Halter | 242/65 |
| 4,883,233 | 11/1989 | Saukkonen et al. | 242/66 |
| 5,029,762 | 7/1991 | Behrens et al. | 242/18 A |
| 5,100,072 | 3/1992 | Behrens et al. | 242/18 A |
| 5,163,631 | 11/1992 | Borer | 242/18 DD |

FOREIGN PATENT DOCUMENTS

| | | |
|---|---|---|
| 0394197 | 4/1990 | European Pat. Off. . |
| 3627463 | 8/1986 | Fed. Rep. of Germany . |
| 3736696 | 10/1987 | Fed. Rep. of Germany . |
| WO90/00511 | 1/1990 | PCT Int'l Appl. . |
| 2080257 | 7/1981 | United Kingdom . |
| 2224272 | 10/1989 | United Kingdom . |

*Primary Examiner*—John M. Jillions
*Attorney, Agent, or Firm*—Oliff & Berridge

[57] ABSTRACT

A process and apparatus for the winding-up of material webs on winding cores is provided. A material web is fed via a winding drum to a winding core or roll. The winding drum is displaceable, while the roll is blocked against displacement during winding. An adjusting device keeps the winding drum under constant pressure against the roll or with a constant clearance from it. With the roll diameter growing, the winding drum is o displaced against the force of the adjusting device into a limit position. On reaching the limit position, the blocking of the roll is released and the adjusting device pushes the winding drum into another limit position, whereupon the roll is again blocked. This sequence of movements is repeated until the roll is finished.

13 Claims, 3 Drawing Sheets

METHOD AND APPARATUS FOR PRODUCING ROLLS

BACKGROUND OF THE INVENTION

1. Field of the Invention

The invention relates to a method and an apparatus for producing rolls from endless, flexible, sheet-form material and, more particularly, to a method and an apparatus for producing rolls at high speeds with different operating systems.

Apparatuses for producing rolls are known. They serve for the initial winding-up or re-winding of woven or non-woven fabrics, papers, films or composite materials, which may be plastically and/or elastically deformable, which may have an adhesive coating or shrinking properties, and which may have dimensions and material properties that are very different in every respect.

A frequent use of such winders is for winding up plastics films which are produced in an upstream blow-molding or slot extruder.

The diameters and lengths of the winding cores and the outside diameters of the rolls may be very different. The thicknesses of the materials to be wound up lie in the range of 5–1000 μm, and the speeds of the material fed in vary between 1 and 1000 m/min.

The requirements for these winders are very varied, corresponding to the properties, dimensions and feed rates of the materials to be wound up as well as to the dimensions and weights of the rolls to be produced.

The rolls must be of high quality, which means, inter alia, that the material being wound must not have any points where there is overstretching or initial tearing, that no folds are formed in the material and that winding is performed firmly enough that the individual turns do not slip over the winding core and shift telescopically in the direction of the winding core axis. Also required is a continuously high working rate, and in order to meet this requirement a changing of the finished roll for an empty winding core while the winder is running is envisaged. Such a change must be carried out to a possible extent without any material loss. Furthermore, the contact pressure or the clearance between the roll and winding drum is to be both constant during a winding operation and able to be set in adaptation to the material to be wound.

EP-A-O 394 197 discloses a winder on which rolls are produced by contact-winding, that is with the winding drum in contact with the roll produced. In the case of this winder, both the winding cores and the winding drum are driven during the winding operation. The winding cores are received in a winding core carrier which is fixed in place during the winding operation, which is referred to as "static" mounting. The winding drum is mounted displaceably, perpendicularly to its axis of rotation, which is referred to as "dynamic" mounting. In a comparison with an arrangement in which the rolls, or the winding cores, are mounted "dynamically" and the winding drum is mounted "statically", this has the advantage that the contact pressure can be kept at a constant value without any problems. This keeping-constant of the contact pressure is made more difficult in the case of a "dynamic" mounting of the rolls due to the fact that their dimensions and weights change during the course of the winding operation and can assume high values. In the case of the winder mentioned, the winding drum is displaced during the production of a roll from a forward position in the vicinity of the winding core at the beginning of the winding operation to a rearward position caused by the growing roll, to be precise against the force of an adjusting device, which serves the purpose of keeping the contact pressure constant between the winding drum and roll, which is necessary for the production of a roll of good quality.

The disadvantage of this winder is that the winding drum is displaced over a distance which is approximately the same size as the radial difference between the winding core and the finished roll. This has the consequence that the material loss which occurs during the changing of a wound winding core for an empty winding core is relatively great. In addition, with this winder, winding can only be performed by the contact process, so that it cannot be used for processing materials which have to be wound by the gap-winding or clearance-winding process, i.e., in which the winding drum and the roll must not touch during the winding operation.

SUMMARY OF THE INVENTION

The present invention is thus based on the object of proposing a process and an apparatus for the winding of flexible, sheet-form, continuously fed material of the type mentioned, with which a cost-effective contact-winding and gap-winding of materials of the widest variety of properties and dimensions is possible at high speeds with different operating systems to form rolls of good quality.

The object is achieved according to the present invention.

The novel winder can be used both for contact-windings and for gap-windings. It combines to a certain extent the advantages of a "static" mounting of the winding drum, i.e., the small material loss during the winding core change, due to the fact that the path of movement of winding drum is very short, and that the winding drum even in its rearward position is close to its original position, with the advantages of a "static" mounting of the winding core or of the roll, that is the good controllability of the contact pressure or of the clearance. In this case, the winding drum is indeed "dynamically" mounted, but—unlike in the case of known apparatuses—is not only displaced continuously away from the winding core over a relatively great distance, but returns periodically in one step into its initial position. The distance which the winding drum has to overcome during the winding core change is thus much smaller than in the case of the known apparatus, so that the material loss thereby occurring is reduced. The winding core receiving means is mounted "statically", and therefore favorably for accurate control, to the extent that it remains fixed in place during the continuous rearward movement of the winding drum and is in each case displaced only in synchronism with the forward-directed steps of the winding drum in such a way that the contact pressure of gap remains constant.

It is generally preferred in contact-winding to drive the winding drum by a motor and the winding core with the roll indirectly, since the mass of the winding drum is constant. If the contact pressure has to be very small, however, the winding core is additionally or exclusively driven by a motor. The winding drum then no longer serves alone, or no longer serves at all, for feeding the material, but predominantly or exclusively for generating the precise contact pressure. Otherwise, the operating principle of the winder is in both cases the same and as described above.

The novel winder can also be used for gap-winding. In this case, of course, the winding core must be driven by a motor. The winding drum can likewise be driven by a motor, but it can also be driven indirectly by the material to be wound up and serve for orderly material feeding. Just as in contact-winding, the contact pressure has to be kept as constant as possible. In addition, in gap-winding, the gap or the clearance between the circumferential surface of the winding drum and the respectively outermost winding of the roll being produced has to be kept as constant as possible. In the case of gap-winding, the winding drum can initially move rearward, with the winding core blocked, and subsequently, after reaching its rearward limit position, move back into its forward limit position. During the rearward displacement of the winding drum, the winding core remains fixed in place. During its forward displacement, it is displaced synchronously in such a way that the mutual distance is preserved.

The novel winder can, moreover, by suitable choice of the operating mode, be used like a conventional winder, to be precise both for contact-winding and for gap-winding. This is desirable, in particular, if trouble-free materials have to be wound.

BRIEF DESCRIPTION OF THE DRAWINGS

Preferred illustrative embodiments of the invention are described in detail below with reference to the drawings, in which.

DETAILED DESCRIPTION OF PREFERRED EMBODIMENTS

Figure 1:
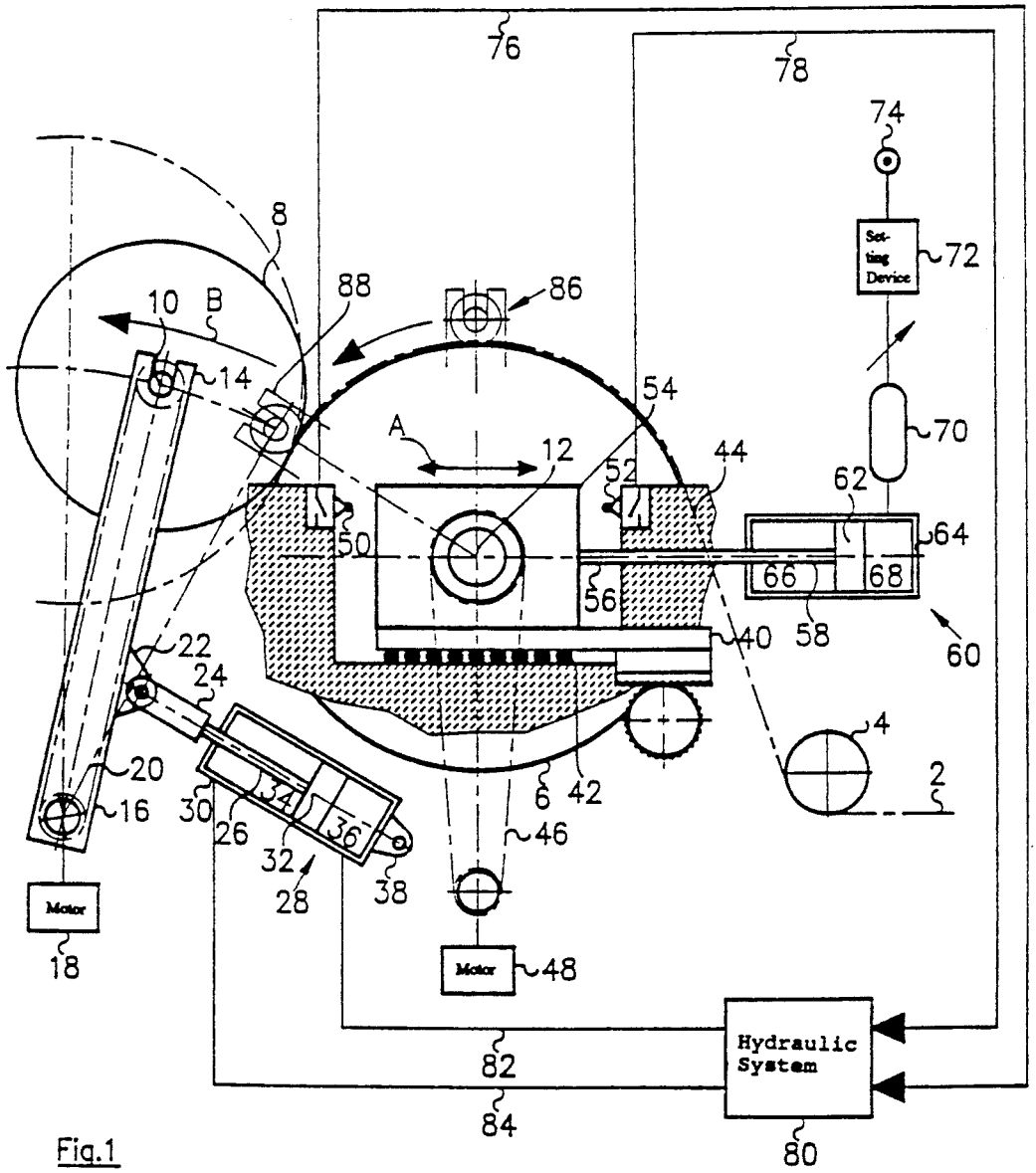
FIG. 1 shows a simplified diagrammatic representation of a first illustrative embodiment of the apparatus according to the invention, for contact-winding.

FIG. 1 shows a web 2 of the material to be wound up, which runs via a deflecting and/or tensioning roller 4 and via a winding drum 6 to a roll 8 being produced. This roll 8 is wound on a sleeve-shaped winding core 10, for example of steel, cardboard or plastic, which is arranged parallel to the axis 12 of the winding drum 6. The winding core 10 is received rotatably in a winding core bearing 14, which is provided at the two upper ends of a pair of lever arms 16. A motor 18 and an endless drive 20 serve as a drive mechanism for the winding core 10. As described further below, these drive mechanisms can in certain cases be switched off, namely whenever the winder is operated as a straightforward contact winder. In this instance, the winding core is made to rotate only indirectly by the winding drum bearing against the roll.

At an attachment 22 of the pair of lever arms 16, there is articulated one end 24 of a piston rod 26 of a, for example, fluid-operated blocking and depositing device referred to from now on as blocking device 28. This blocking device 28 essentially comprises a cylinder 30, the interior of which is divided by a piston 32, fastened to the piston rod 26, into a first chamber 34 and into a second chamber 36. The cylinder 30 is jointedly supported at its end neighboring the chamber 36 on a shaft 38.

The winding drum 6 is rotatably mounted in a slide 40, which can be displaced virtually without any friction, for example by means of a ball bearing or roller bearing 42, on a fixed part 44 of the stand of the winder, which otherwise is not represented in any more detail. The winding drum 6 is made to rotate by a drive mechanism having an endless drive 46 and a motor 48. If the roll 8 is driven by a motor, this drive mechanism of the winding drum 6 can, as described further above, be switched off. This is, for example, the case if the winder is used for gap-winding, which is always necessary if, due to the properties of the material to be wound up, no pressure may be exerted on the roll being produced. The drive mechanism of the winding drum 6 can also be switched off if the contact pressure is to be very small, so that an indirect drive of the roll 8 by the winding drum 6 is no longer possible or would not suffice.

The winding drum 6 can, moreover, be displaced back and forth, together with the slide 40, linearly (and in FIG. 1 horizontally) between a forward limit position (on the left in FIG. 1) and a rearward limit position (on the right in FIG. 1). In FIG. 1, the slide 40 and the winding drum 6 assume a middle position between the two limit positions, and the length of the displacement path is indicated by a double-headed arrow A.

The fixed part 44 of the winder has a front limit switch 50 and a rear limit switch 52 which, together with a housing part 54 of the slide 40, by which they can be operated, form a detector arrangement. The limit positions between which the slide 40 can move are fixed by the position of the limit switches 50 and 52.

Also acting on this housing part 54 is one end 56 of a piston rod 58, which belongs to a, in this case, fluid-operated, adjusting device 60. The other end of the piston rod 58 is fastened to a piston 62, which divides the interior of a cylinder 64 into a first, front chamber 66 and into a second, rear chamber 68. This second chamber 68 is connected via a pressure-fluid reservoir 70 and a setting device 72, for example a proportional valve, to a pressure source or a pressure system 74. It is essential here that the volume of the pressure-fluid reservoir 70 is very much greater than the volume or the possible volume change of the chamber 68.

The limit switches 50 and 52 are connected via lines 76 and 78, respectively, to a hydraulic system 80. Hydraulic system 80 is connected by lines 82 and 84 to the chambers 36 and 34, respectively, of the blocking device 28.

The operating principle of the components described above—starting from their position represented in FIG. 1—is as follows:

The winding drum 6 and the roll 8 rotate, driven by a motor or indirectly, about their axes. The web 2 fed in at the same time via the winding drum 6 is continuously wound up further onto the roll 8, so that the outside diameter of the latter constantly increases.

The pair of lever arms 16 with the winding core bearing 14 is pneumatically, hydraulically or mechanically blocked in its momentary position by means of the blocking device 28.

By means of the appropriately calibrated setting device 72, the desired contact pressure is preselected, thereby determining the pressure in the pressure-fluid reservoir 70 and in the chamber 68. This pressure acts on the piston 62, which exerts a force (directed to the left in FIG. 1) on the slide 40 via the piston rod 56 and consequently causes the desired contact of the winding drum 6 against the roll 8.

During further winding up of the web 2, the outside diameter of the roll 8 increases. Since the pair of lever arms 16 with the winding core bearing 14 cannot move, the growing roll 8 pushes the winding drum 6 against the force of the adjusting device 60 rearward into its rearward limit position, so that the housing part 54 touches the limit switch 52. Due to the blocking of the winding core 10, the roll 8 thus serves to a certain extent as an adjusting device for the winding drum 6 and exerts on the latter a force which is essentially opposed to the force of the adjusting device 60 and is greater than the latter force.

The limit switch 52 activated by the housing part 54 then supplies a signal via the line 78 of the fluid device 80, whereupon the fluid device 80 releases the blocking of the pair of lever arms 16 with the winding core receiving means 16. Since the pair of lever arms 16 can now swing out in accordance with the arrow B in FIG. 1, the force exerted on the winding drum 6 by the increasing roll 8 is essentially reduced to the weight of the roll, whereas the force exerted by the blocking device 28 via the roll 8 on the winding drum 6 ceases. The latter is therefore pushed under the action of the adjusting device 60 with a leftward directed movement into its forward limit position, so that the housing part 54 operates the limit switch 50.

As a consequence, the limit switch 50 supplies a signal to the fluid device 80 via the line 76. The fluid device 80 thereupon again blocks the pair of lever arms 16 with the winding core bearing 14 by means of the blocking device 28. This blocking prevents the increasing roll 8 from evading the winding drum 6 as the increasing roll increases in its radius during the continuation of the winding operation. In order to obtain space for its increasing volume, the roll 8 therefore in turn pushes the winding drum 6 continuously rearward (to the right in FIG. 1), until the position represented in FIG. 1 is again assumed, whereby a sequence of movements is completed.

This sequence of movements consequently comprises a continuous rearward movement of the winding drum 6 as far as its rearward limit position, the winding core bearing 14 with the roll 8 being held fixed in place, and a subsequent forward movement of the winding drum 6, carried out in one step, into its forward limit position, the winding core bearing 14 with the roll 8 executing a synchronous step, in such a way that the chosen contact pressure remains constant.

Such sequences of movements are repeated until the desired length of material has been wound up or until the roll 8 has reached the desired final diameter or the desired final weight. There then takes place in a cross-cut the severing of the web part still belonging to the roll 8 from the following web part, which will form the innermost winding of the next roll. The finished roll 8 is then transported away out of the winding station in a known way and in its place a next winding core enters the winding core bearing 14, as is described, for example, in US-A-4 191 341.

This next winding core 10 is shown in FIG. 1 in two positions, namely under 86 in a waiting position and under 88 shortly before the transfer into the winding core bearing 14.

It is pointed out that the contact pressure, the accurate maintaining of which during the winding-up of certain materials is an essential condition for producing a roll of high quality, is kept virtually constant in the simplest way and nevertheless sufficiently accurately. This takes place merely by means of the control device, by means of which the desired value is set, that is without feedback of a measured actual value of the contact pressure. Due to the relatively large volume of the pressure-fluid reservoir, the pressure in the chamber 68 of the adjusting device 60, and consequently the contact pressure of the winding drum 6 against the roll 8, changes only in the range of 1%, thus ensuring sufficient accuracy. This accuracy, which is achieved with a cost-effective, simple and operationally reliable construction, is adequate in many areas of application.

Figure 2:
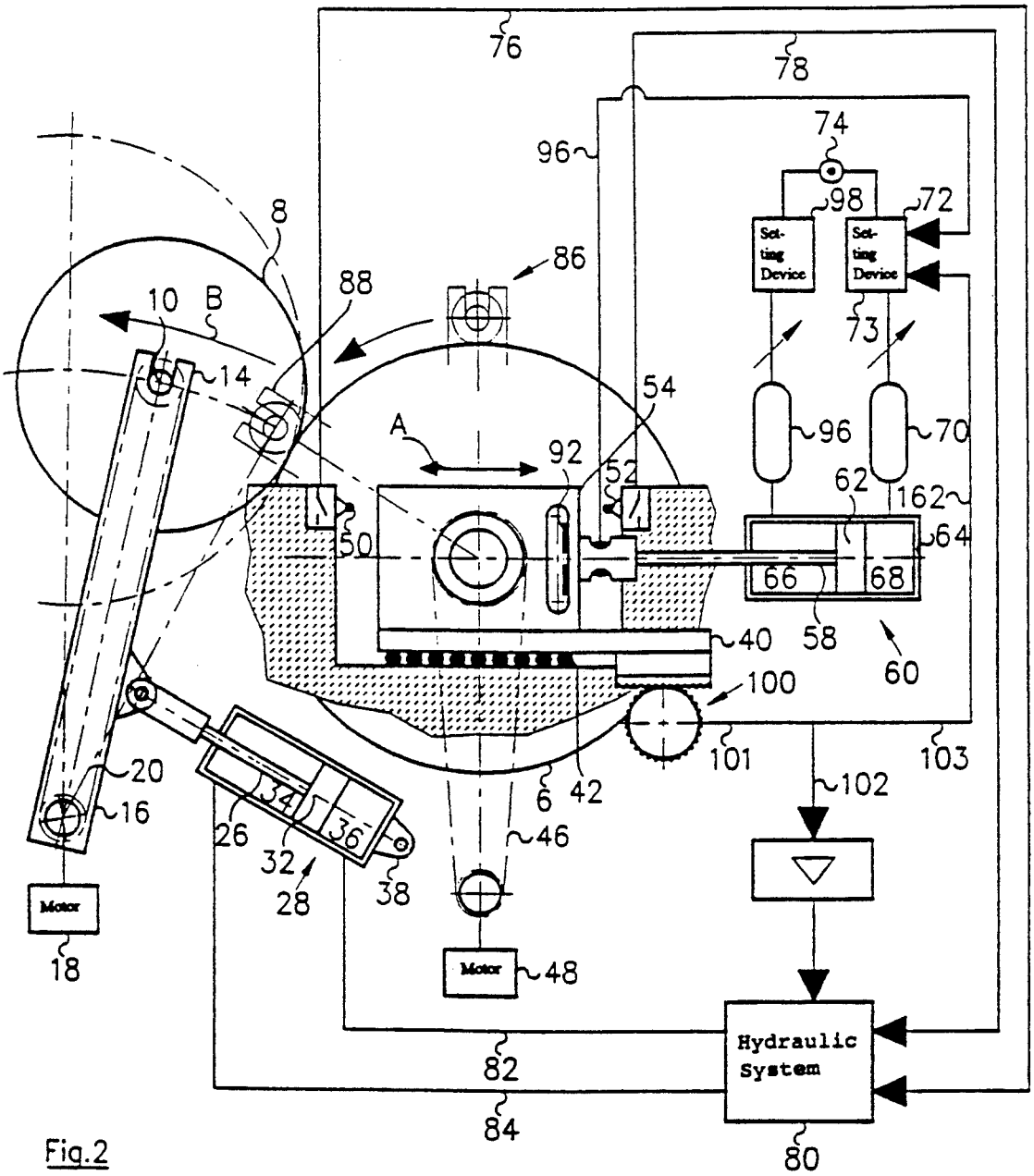
FIG. 2 shows a simplified diagrammatic representation of a second illustrative embodiment of the apparatus according to the invention.

In the case of the apparatus according to FIG. 2, various components of the apparatus according to FIG. 1 are likewise represented and provided with the same reference symbols. In addition, the apparatus according to FIG. 2 has further components, described below.

Initially, the winding drum 6 is provided on its housing 54 or on a cylinder fork 90 arranged thereupon with wire strain gauges 92, which determine the actual value of the contact pressure acting from the adjusting device 60 via the winding drum 6 on the roll 8. The wire strain gauges 92 are connected via a line 94 to the setting device 72, which is supplemented by a comparison unit 73.

Secondly, the chamber 66 of the adjusting device 60 is connected via a further pressure-fluid reservoir 96 and a further setting device 98 to the pressure source or the pressure system 74.

Thirdly, a displacement or incremental pick-up 100 is provided as a detector arrangement for establishing the relative movement between the slide 40 with the winding drum 6 and the fixed part 44 or for sensing the limit positions of the winding drum 6. This pick-up 100 functionally replaces the limit switches 50 and 52, which can be retained however as safety switches and/or, with the pick-up switched off, for operating the winder according to the description relating to FIG. 1. The pick-up 100 is connected via lines 101, 102 to the fluid device 80 and via the line 101 and a line 103 to the setting device 72.

These three subassemblies and the improvements which can be achieved by their operation can also be provided individually, but generally one would not provide the damping device without the actual-value measurement.

With the function of the apparatus otherwise the same as described with respect to FIG. 1, the operating principle of the additional elements is as follows:

As already described, the wire strain gauges 92 determine indirectly the actual value of the contact pressure and supply a corresponding signal via the line 94 of the setting device 72, which signal is compared by the comparison device 73 with the set desired value of the contact pressure. If the actual value deviates from the desired value, a change of the set value automatically takes place. The open control loop for the contact pressure according to FIG. 1 has consequently been replaced in the case of the apparatus according to FIG. 2 by a closed control loop, which although more complex to produce has the consequence in operation of even more accurate maintenance of the desired contact pressure.

By means of the additional pressure-fluid reservoir 96 and the associated setting device 98, a counter-pressure with respect to the contact pressure can be exerted in accordance with requirements, which produces the effect of a hydraulic spring, or damping or compensation.

The displacement or incremental pick-up 100 continuously determines the respective position of the slide 40 or of the winding drum 6. Via the lines 101 and 102, it supplies corresponding signals to the fluid device 80 when the slide 40 reaches one of its limit positions. On reaching the rearward limit position, the fluid device 80 causes the blocking device 28 to release the pair of lever arms 16, so that they pivot counterclockwise under the effect of the adjusting device 60. On reaching the forward limit position, the fluid device 80 causes a renewed blocking of the pair of lever arms 16, so that the winding drum 6 is again pushed to its rearward end position. Due to the feedback of the values determined by the pick-up 100 via the lines 101 and 102 to the setting device 72, supplemented by the comparison unit 73, a closed-loop control of the effect of the adjusting device 60 takes place.

In the case of the arrangement of a displacement pick-up 100, the sequences of movements described earlier, or the forward and rearward movements of the slide 40, can be shortened, i.e., the distance between the limit positions can be reduced. The continuous rearward displacement and the forward-directed step of the slide 40 or of the winding drum 6 thus become more frequent and shorter. This has the consequence that the displacement of the roll 8 likewise takes place in smaller time intervals and over shorter distances, that is in smaller steps. Consequently, smoother running of the apparatus is achieved.

In the case of the arrangement of an incremental pick-up 100, the operating principle is basically the same as described above, it being possible to reduce the distance between the limit positions to an infinitesimal value. As a result, the sequences of movements are transformed into a scarcely visible oscillation between the very closely adjacent limit positions. The winding drum 6 remains essentially in the same position during the entire winding operation and the fluid device controls the movement of the pair of lever arms 16 with the winding core bearing 14 via the adjusting device 28 in such a way that a continuous counterclockwise movement of the roll 8 takes place. This does not mean, however, that the apparatus works in the manner of a conventional winder with locationally fixed winding drum and without control, or with sluggish control, of the contact pressure. The winding drum 6 is to a certain extent floatingly fixed with respect to its forward and rearward movements and control of the movements of the pair of lever arms 16 and consequently the roll 8 takes place in a fluid-operated and consequently inertialess manner.

When winding troublefree materials by the contact-winding process, as mentioned earlier, the novel winder can also be operated in a conventional way, i.e., without contact-pressure control and without displacing the winding drum 6. The winding drum 6 is in this case held fixed in a certain position, generally in its forward end position. The blocking of the pair of lever arms (16) with the roll (8) is released. During winding-up of the material, the pair of lever arms 16 with the roll 8, the radius of which increases continuously, swivels under the pressure of the fixed winding drum 6 continuously in a counterclockwise direction, until the roll 8 has reached its final size.

Figure 3:
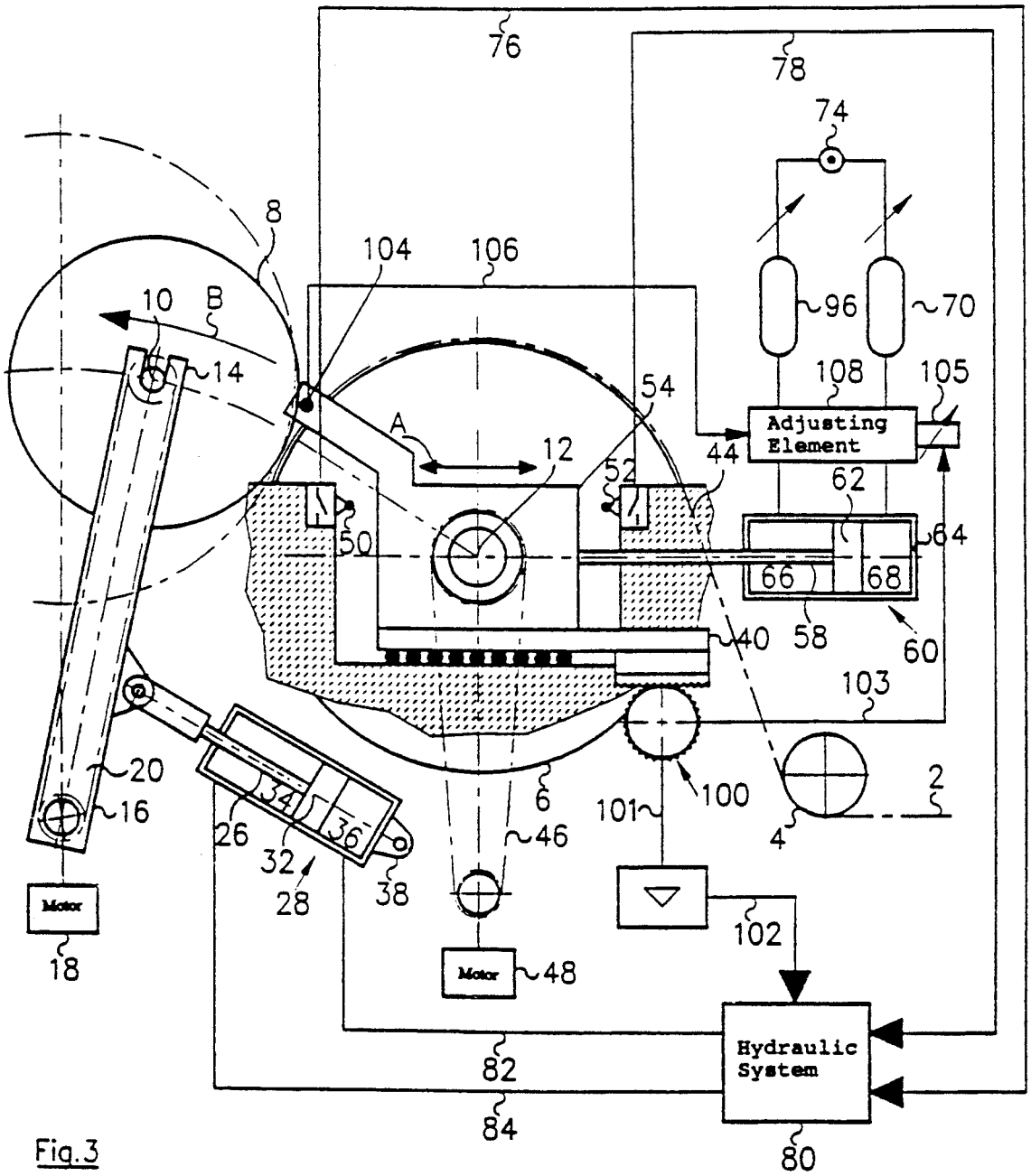
FIG. 3 shows a simplified diagrammatic representation of a third illustrative embodiment of the apparatus according to the invention, for gap-winding.

FIG. 3 shows, greatly simplified, a winder designed for gap-winding with several components which have been described with respect to the apparatuses according to FIGS. 1 and 2; these are also provided with same reference symbols. The additional components serve the purpose of carrying out contactless, that is so-called gap-windings or clearance-windings with the winder.

It should be noted in this respect that, depending on the planned use, a winder according to the invention can be designed as a straightforward gap-winder or switchably as a contact-winder and gap-winder (and of course, also as a straightforward contact-winder). The components for gap-winding can thus be arranged in addition to the components which are required just for contact-winding.

Provided as a novel feature for gap-winding is an optical or electronic sensor device 104, generally with photocells, by which the winding gap, i.e., the distance between the respective outermost material layer of the roll 8 and the circumferential surface of the winding drum 6, is determined. The sensor device 104 with a setting device 105 is connected via a line 106 to an adjusting element 108. This adjusting element 108 connects both the chamber 68 of the adjusting device 64 to the pressure-fluid reservoir 70 and the chamber 66 of the adjusting device 64 to the pressure-fluid reservoir 96.

With otherwise the same operating principle of the apparatus as that of the apparatuses represented in FIG. 1 and FIG. 2, the operating principle of these components is as follows:

The pair of lever arms 16 with the winding core 8 and the winding drum 6 are initially blocked against movement perpendicularly to their axes. The winding core 10 is driven by a motor, as a result of which the web 2 is wound up on it, after it has run via the winding drum 6 driven thereby. The winding gap, the desired value of which is preselected by means of the setting device 105, i.e., the distance between the winding drum 6 and the roll 8 being produced, is reduced when newly wound-up material increases the radius of the roll 8 during the winding operation with the pair of lever arms 16 blocked. Once the gap has been reduced to a certain extent, the sensor device 104 activates the adjusting device 60 via the line 106 and the adjusting element 108 in such a way that the slide 40 with the winding drum 6 is moved to the right. The winding and rearward displacement of the slide 40 are continued until the arrival of the winding drum 6 in the rear limit position is established by the corresponding sensor device, i.e., the limit switch, the displacement pick-up or the incremental pick-up. Then the blocking of the pair of lever arms 16 and the action of the adjusting device pushing the winding drum to the right are interrupted in the manner already described. The adjusting device 60 then pushes the winding drum 6 back into its forward limit position, and at the same time the pair of lever arms 16 pivots counterclockwise to the extent that the gap is preserved.

As already mentioned, the winder can also be used in a conventional way as a gap-winder, the winding drum being blocked in a fixed position. The step-by-step movement of the pair of lever arms with the roll is controlled by, in this case, a fixed sensor device or light barrier. A light beam monitors the distance between the winding drum and roll. As soon as the outermost roll layers have reduced this distance to a certain value, the light barrier acts via the control device on the adjusting device, which as a consequence causes the swivelling of the pair of lever arms in a counterclockwise direction.

As a result, the distance between the roll and the winding drum increases until the light barrier emits a signal to end this movement of the pair of lever arms. All these operations are repeated until enough material has been wound up on the roll in order for the latter to have reached its final diameter.

Depending on the dimensions and weights of winding core and roll, in the case of all the illustrative embodiments according to the invention, there may be a plurality of parallel adjusting devices respectively provided. In the winding of less wide material, adjusting devices not required can be switched off.

In the case of the illustrative embodiments described above, the winding drum is arranged on a linearly displaceable slide and the roll is arranged on a swivellable pair of lever arms. It is also possible, however, to arrange the winding drum on a pair of lever arms and/or the roll on a linearly displaceable slide.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method for producing rolls from flexible sheet material, said material being fed in continuously via a rotatably mounted winding drum, said method comprising:

bearing said material against a part of a circumference of said winding drum;

winding said material consecutively on one of a plurality of winding cores, said winding cores being fed in one after the other at a time interval;

driving and rotating said one winding core, about an axis parallel to an axis of rotation of said winding drum during a winding operation;

moving said winding drum against an adjusting force from a forward limit position to a rearward limit position, essentially perpendicularly to said axis of rotation in accordance with an increase in radius of a roll being produced;

preventing displacement of said roll in a perpendicular direction with respect to the rotation axis of said roll during said movement of said winding drum from said forward to said rearward limit position;

maintaining said roll and said winding drum under one of mutual, essentially constant contact pressure and essentially constant clearance during said moving of said winding drum;

releasing said roll to enable displacement in a perpendicular direction with respect to the rotation axis of said roll when said winding drum reaches said rearward limit position;

after release of said roll, moving said winding drum under the adjusting force to said forward limit position;

synchronously with moving said winding drum to said forward limit position, moving said roll such that one of the contact pressure and clearance remains constant; and after arrival of said winding drum at said forward limit position, repeating the movement of said winding drum between said forward and rearward limit positions until said roll reaches a predetermined size, wherein displacement of the roll is blocked in a perpendicular direction with respect to said rotation axis during each movement of said winding drum from said forward to said rearward limit position and displacement of the roll is allowed during each movement of said winding drum from said rearward to said forward limit position.

2. An apparatus of producing rolls from flexible sheet material, said apparatus comprising:

feeding means for continuously feeding flexible sheet material;

a bearing device rotatably receiving a winding drum, said winding drum having a circumference, a part of said circumference having said sheet material adapted to bear thereagainst, said bearing device being movable in a direction essentially perpendicular to a rotational axis of said winding drum between a forward limit position and rearward limit position;

biasing means acting upon said bearing device for urging said bearing device towards said forward limit position;

a winding core bearing for rotatably carrying a winding core during a winding operation, said winding core having a rotational axis which is parallel to the rotational axis of said winding drum during said winding operation, said winding core bearing being mounted for displacement together with said winding core in a perpendicular direction with respect to the rotational axis of said winding core;

a releasable blocking means for temporarily blocking said winding core bearing against displacement during the movement of said bearing device form the forward to the rearward limit position, whereby said bearing device together with said winding drum is moved form said forward to said rearward limit position against the action of said biasing means in accordance with the increase in radius of the roll being produced on said winding core while said blocking means blocks said winding core bearing against displacement;

a control and adjusting means including said biasing means for controlling the movement of said bearing device, said control and adjusting means further comprising:

detector means for detecting when said bearing device reaches said forward and rearward limit positions; and control means which causes said blocking means to cease blocking winding core bearing displacement when said detector means detects arrival of said bearing device at said rearward limit position and thus allowing said bearing device to move to said forward limit position and said roll to simultaneously move such that one of the contact pressure and clearance between said winding drum and said roll remains constant, said control means causing said blocking means to again block winding core displacement upon arrival of said bearing device at said forward limit position.

3. The apparatus according to claim 2, wherein said winding drum is driven by a drive mechanism.

4. The apparatus according to claim 2, wherein said winding core is driven by a drive mechanism.

5. The apparatus according to claim 4, wherein said control means comprises one of an optical and an electronic sensor device which actuates said control means, said sensor device monitoring change in a clearance between said winding drum and a roll being produced on said winding core.

6. The apparatus according to claim 2, wherein said detector means comprises limit switches coupled to said biasing means and said blocking means.

7. The apparatus according to claim 2, wherein said detector means comprises at least one of a displacement pick-up device and an incremental pick-up device, coupled to said biasing means and said blocking means.

8. The apparatus according to claim 2, wherein said control means comprises a pressure fluid operated device for causing said blocking means to release and block said winding core bearing displacement.

9. The apparatus according to claim 2, wherein said control means comprises a pressure fluid operated device for moving said bearing device to said forward limit position.

10. The apparatus according to claim 8, wherein said pressure-fluid operated device comprises a cylinder having an interior divided by a piston into first and second chambers, one end of said cylinder being supported on a shaft pivotally attached to at least one lever arm supporting said winding core.

11. The apparatus according to claim 9, wherein said pressure-fluid operated device comprises a cylinder having an interior divided by a piston into first and second chambers, one of said chambers being connected to a pressure source by a pressure-fluid reservoir and a setting device, said pressure-fluid reservoir having a larger volume than a possible volume change of said one chamber.

12. The apparatus according to claim 2, wherein said detector means comprises limit switches, said limit switches being connected to a hydraulic system, said hydraulic system being connected to said blocking means.

13. The apparatus according to claim 2, wherein said detector means comprises at least one strain gauge for determining contact pressure, said at least one strain gauge being connected to a setting device, said setting device providing a signal to a comparison device which compares said signal with a desired contact pressure value.

* * * * *